US009074374B1

(12) United States Patent
Chao

(10) Patent No.: US 9,074,374 B1
(45) Date of Patent: Jul. 7, 2015

(54) GUTTER CLEANING APPARATUS

(71) Applicant: Albert Chao, Saddle River, NJ (US)

(72) Inventor: Albert Chao, Saddle River, NJ (US)

(73) Assignee: Albert Chao, Saddle River, NJ (US)

( * ) Notice: Subject to any disclaimer, the term of this patent is extended or adjusted under 35 U.S.C. 154(b) by 0 days.

(21) Appl. No.: 14/477,402

(22) Filed: Sep. 4, 2014

(51) Int. Cl.
*A47L 5/38* (2006.01)
*E04D 13/076* (2006.01)

(52) U.S. Cl.
CPC ..... *E04D 13/0765* (2013.01)

(58) Field of Classification Search
CPC ..... E04D 13/0765
USPC ..... 15/301, 316.1, 317; 52/12, 14, 16; 405/119; 134/166 C, 168 C, 167 C, 170
IPC ..... A47L 5/38
See application file for complete search history.

(56) References Cited

U.S. PATENT DOCUMENTS

| | | | |
|---|---|---|---|
| 3,971,098 | A | 7/1976 | Davis |
| 4,349,039 | A | 9/1982 | Egger |
| 4,402,106 | A | 9/1983 | Mattson |
| 4,502,806 | A | 3/1985 | Albertson |
| 4,634,312 | A | 1/1987 | Sterzel |
| 5,056,187 | A | 10/1991 | Higgins |
| 5,195,209 | A | 3/1993 | Watkins |
| 6,519,809 | B2 | 2/2003 | Gutry |
| 6,766,560 | B2 | 7/2004 | Murphy |
| 6,926,210 | B2 | 8/2005 | Baxter |
| 7,549,191 | B2 | 6/2009 | Seasholtz et al. |
| 8,739,362 | B1 | 6/2014 | Conder |
| 2004/0143931 | A1 | 7/2004 | Dennis |

*Primary Examiner* — David Redding
(74) *Attorney, Agent, or Firm* — Notaro, Michalos & Zaccaria P.C.

(57) ABSTRACT

A gutter cleaning apparatus cleans debris from a gutter having a concave channel for collecting and guiding water from a roof of a building with a water permeable platform for mounting in the gutter at a selected spacing above a floor of the gutter, and an air flow guide engaged to an end of the platform, the guide having an outlet end with lower and upper portions for directing air flow respectively under and over the platform to lifting and remove debris from an upper surface of the platform, the platform extending at least partly into the outlet end for dividing the outlet end into the lower and upper portions, and the guide having an inlet for receiving a forced air flow.

20 Claims, 12 Drawing Sheets

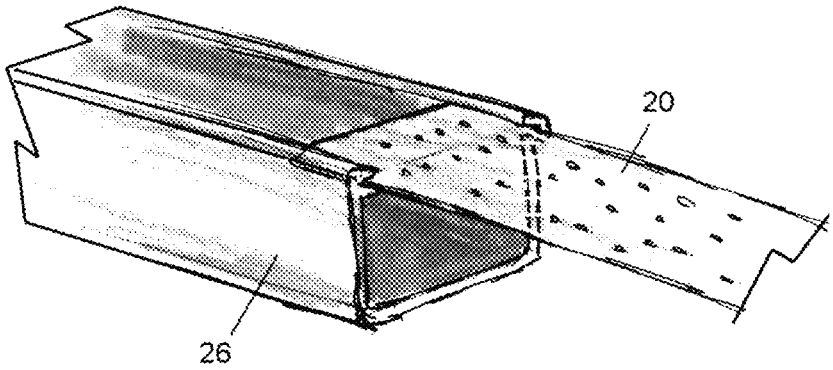
FIG. 17
FIG. 18
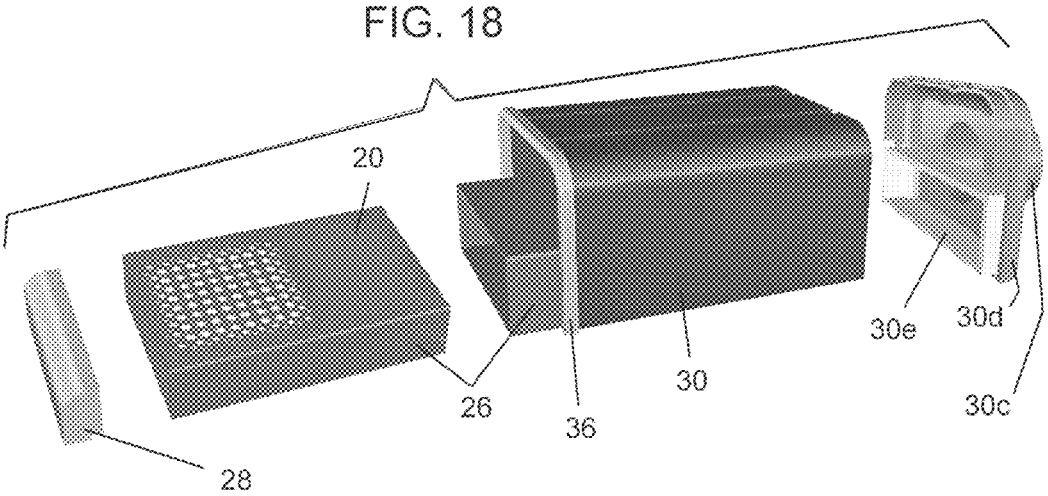

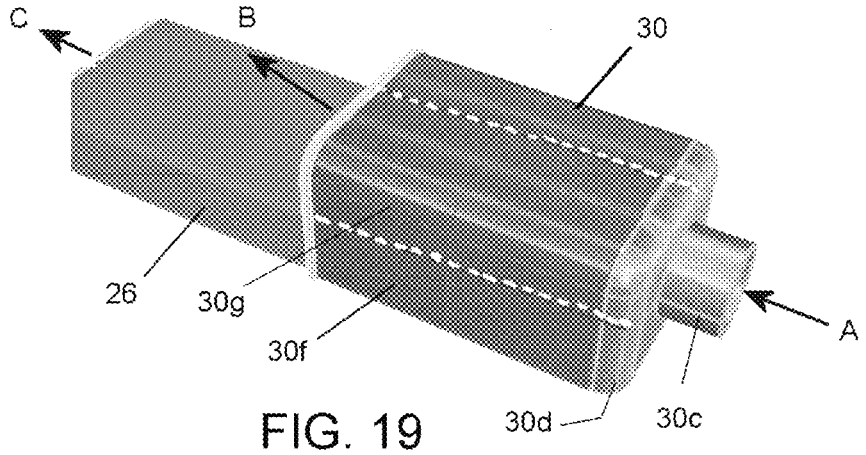
FIG. 19
FIG. 20
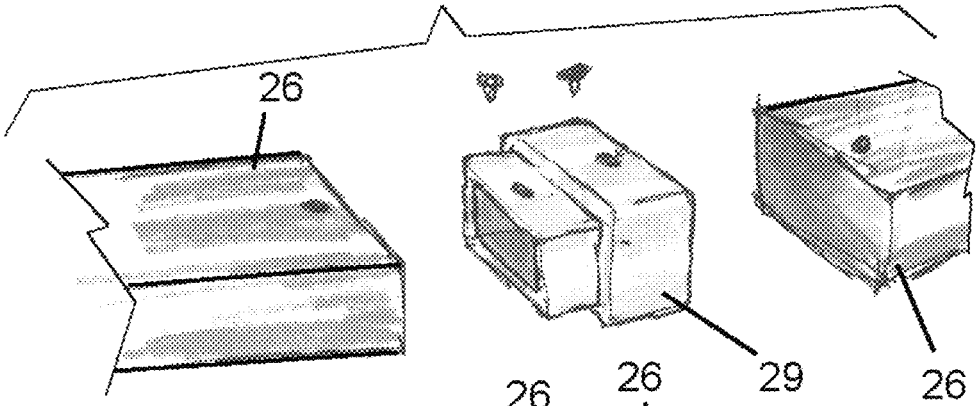
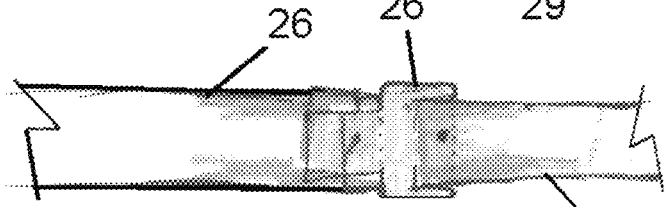
FIG. 21
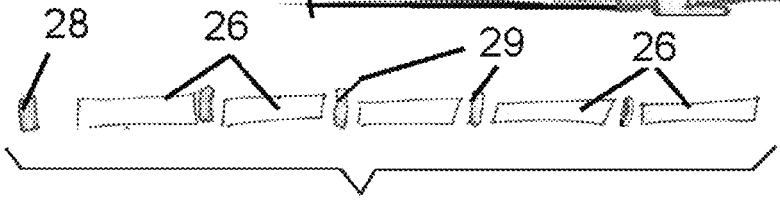
FIG. 22

FIG. 23
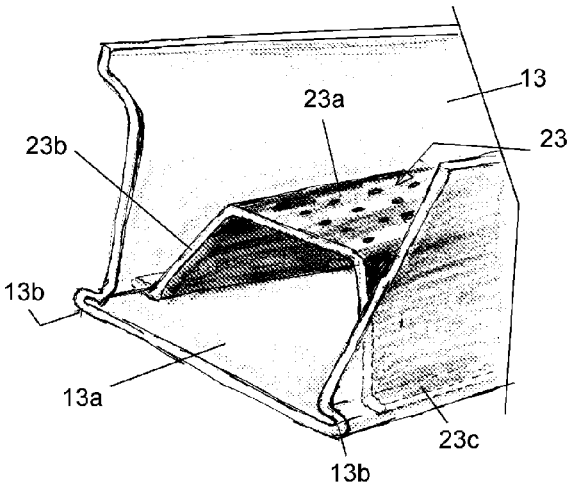
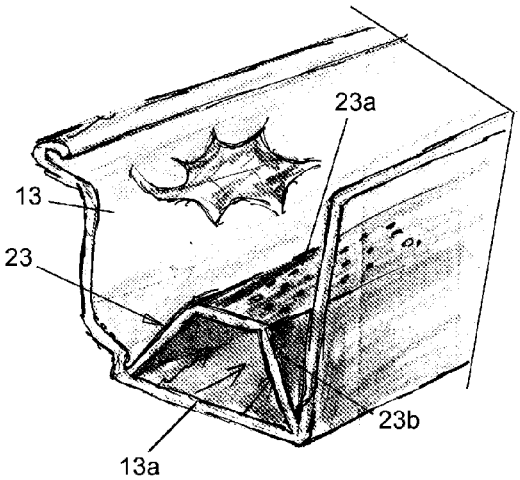
FIG. 24

GUTTER CLEANING APPARATUS

FIELD AND BACKGROUND OF THE INVENTION

The present invention relates generally to the field of house cleaning and maintenance, and in particular to a new and useful gutter cleaning apparatus that can effectively remove leaves and other debris from house gutters.

It is known to use blowers to remove leaves from lawns. Since this is done at ground level, there is no issue of danger or access to the area to be cleaned. While a blower may be effective to remove leaves and debris from gutters, a ladder and long power cord would be needed for electric blowers, and using heavier gas powered blowers would be awkward and potentially dangerous to use high off the ground.

In order to take advantage of leaf blowers to clean gutters, several approaches are known for using long air containing conduits from the blower at ground level up to a guide or other air directing mechanism at the gutter level. See for example, the following: U.S. Pat. No. 3,971,098 for Gutter Cleaning Nozzle; U.S. Pat. No. 4,349,039 for Home Roof Gutter Sweep; U.S. Pat. No. 4,402,106 for Blower Attachment for Cleaning Rain Gutters; U.S. Pat. No. 4,502,806 for Gutter Cleaning Device; U.S. Pat. No. 4,634,312 for Self Cleaning Drain Gutter or Pipe; U.S. Pat. No. 5,056,187 for Eave Trough Cleaning Apparatus; U.S. Pat. No. 5,195,209 for Gutter Cleaning System; U.S. Pat. No. 6,519,809 for Gutter Cleaner; U.S. Pat. No. 6,766,560 for Gutter Leaf-Blower; U.S. Pat. No. 6,926,210 for System for Maintaining Gutter Debris Free; U.S. Pat. No. 7,549,191 for Gutter Cleaning Blower Vacuum Attachment Apparatus; U.S. Pat. No. 8,739,362 for Gutter Cleaning Attachment for a Leaf Blower; U.S. published patent application US 2004/0143931 for Gutter Cleaning System.

It is also known to use water jets to clean gutters. Since gutters are usually one, two or sometimes three stories of the ground, long spray wards are needed for gutters that are closer to the ground, and ladders must be used for higher gutters. Also, if the spray of water is not immediately effective to the remove the leaves and other debris from the gutters, the leaves and debris get wet, heavy and sticky and therefor become more difficult to remove.

A need remains for an effective new way to clean household gutters using a blower rather than a jet of water.

SUMMARY OF THE INVENTION

It is an object of the present invention to provide a gutter cleaning apparatus that uses a blower, preferably near ground level to clean leaves and debris, collectively here called debris, from the gutters of a house or other building, collectively here called a building.

Accordingly, another object of the invention is to provide a gutter cleaning apparatus for cleaning debris from a gutter having a concave, rectangular or curved, channel for collecting and guiding water from a roof of a building, the apparatus comprising, a water permeable platform for mounting in a gutter at a selected spacing above a floor of the gutter, and an air flow guide engaged to an end of the platform, the guide having an outlet end with lower and upper portions for directing air flow respectively under and over the platform to lift and remove debris from an upper surface of the platform, the platform extending at least partly into the outlet end for dividing the outlet end into the lower and upper portions, and the guide having an inlet for receiving a forced air flow.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 17 is a partial perspective view of another embodiment of a platform and channel of the invention;

FIG. 18 is an exploded perspective view of another embodiment of the invention;

FIG. 19 is a perspective view of the embodiment of FIG. 18 to better show the air flow pattern of the invention;

FIG. 20 is an exploded view of a joiner member of an embodiment of the invention for connecting two air flow channels to each other;

FIG. 21 shows the joiner member of FIG. 20, joining two channels to each other;

FIG. 22 is an exploded view showing multiple channels to be connected to each other for servicing a length of gutter according to the invention;

FIG. 23 is a partial perspective view in section of a further embodiment of the invention where the platform is manufactured as a part of the gutter for installation on a building; and FIG. 24 is a view similar to FIG. 23 of a further embodiment of the invention.

DESCRIPTION OF THE PREFERRED EMBODIMENTS

Figure 1:
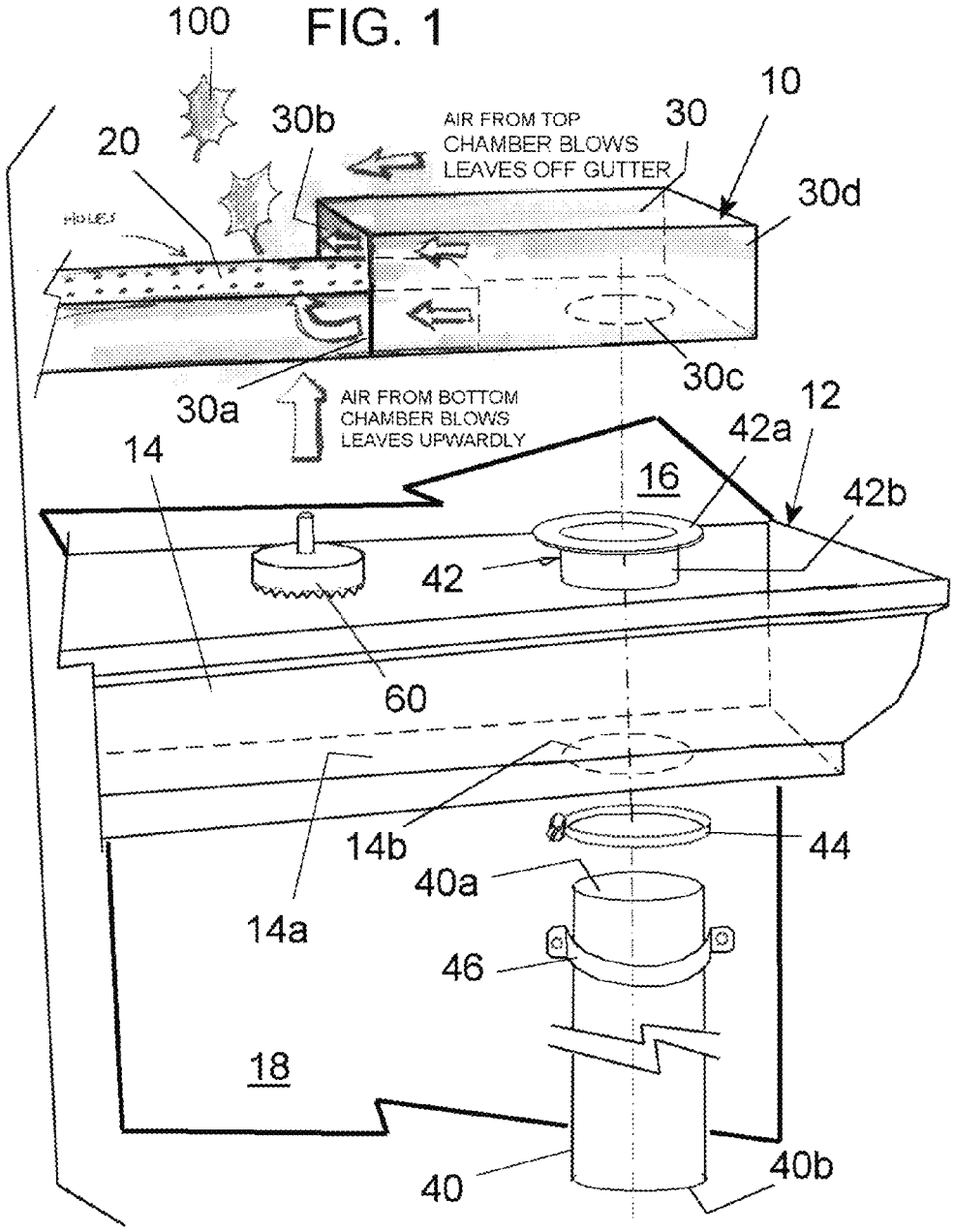
FIG. 1 is an exploded view of a gutter cleaning apparatus according to the present invention.

Referring now to the drawings, in which like reference numerals are used to refer to the same or similar elements, FIG. 1 shows a gutter cleaning apparatus 10 for cleaning debris from a building gutter 12 having a concave channel 14 for collecting and guiding water from a roof 16 of a building 18. The apparatus comprises a water and air permeable platform 20 for mounting in the gutter 12 at a selected spacing above a floor 14*a* of the gutter channel 14 and an air flow guide 30 engaged to an end of the platform 20. The selected spacing is about 1 inch but may be preferable about ½ to 2 inches. Platform 20 preferably has a width to cover the entire floor 14*a* of the gutter which is about 3 to 4 inches in most cases, although customized gutters of other dimensions can also cleaned using the present invention.

The guide 30 has an outlet end with a lower portion 30*a* and an upper portion 30*b* for directing air flow respectively under and over the platform 20 for both lifting debris such a leaves 100, up off the platform, and for removing debris from the platform and gutter, as illustrated by the arrows in FIG. 1.

The platform 20 extends at least partly into the outlet end of guide 30 for dividing the outlet end into the lower and upper portions 30*a* and 30*b*. Guide 30 also has an inlet at 30*c* for receiving a forced air flow from a blower near ground level as will be explained in connection with FIG. 7. Opposite outlet 30*a* and 30*b*, guide 30 has a closed wall 30*d* and its top, sides and bottom are also closed and solid, except for inlet 30*c*. Platform 20 is preferably the perforated top panel of an elongated rectangular or other shaped tube section or channel that is connected along the floor 14*a* of the gutter 12 as will be explained more detail later in this disclosure. As many tube sections as needed are lain end-to-end in the gutter 12. To help maintain some air confinement between adjacent sections, one end of each section may be made smaller than an opposite end to telescope into its neighbor. Otherwise care should be taken to lay one section immediate abutting its neighbor. Some air leakage between sections is acceptable, however, since such leakage will help lift debris up off the junction between sections in any case, in accordance with the desired cleaning effect of the invention.

The tube sections for platforms 20, and the air guide 30 are preferably made of sheet metal, for example aluminum, of a gauge and type that is conventional for building gutters.

Figure 7:
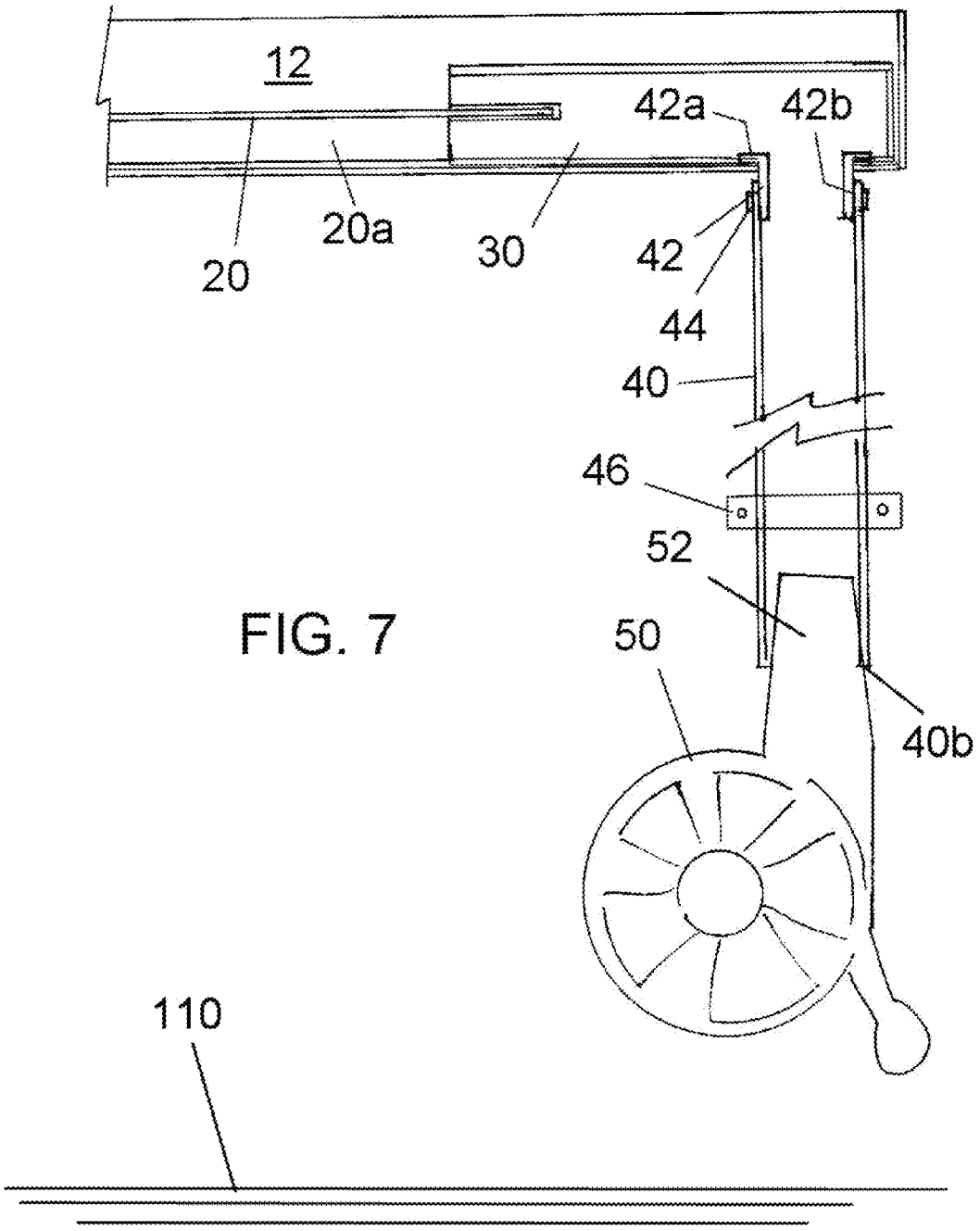
FIG. 7 is a sectional view showing how a blower is utilized near ground level to engage the apparatus of the invention.

As shown in FIGS. 1 and 7, the gutter cleaning apparatus of the invention also includes an air flow conduit or pipe 40 having an outlet 40*a* connected to the air flow guide inlet 30*c*, and an inlet 40*b* adapted to be spaced below the floor 14*a* of the gutter 12, and at a convenient level above the ground 110, for example, about 3 to 5 feet above the ground. Inlet 40*b* is of a diameter and shape to closely receive the outlet tube 52 of a blower shown at 50 in FIG. 7, to receive a forced air flow from the blower.

The outlet 40*a* of conduit 40 is fixed to the air flow guide inlet 30*c* of guide 30 with the aid of a cap fitting 42 having a rim 42*a* that sits on the floor of guide 30, around the inlet 30*c*, and a tubular portion 42*b* that has a slightly smaller outside diameter than the inside diameter of conduit outlet 40*a*. Tubular portion 42*b* extends through a hole 14*b* in the floor 14*a* of the gutter 12, and is then tightly fit into outlet 40*a* of conduit 40, and the cap is fixed to the conduit 40 by a ring clamp 44 of known design, or by adhesive, or by any other known means. Along with an assembly kit that can be sold as a unit to contractors or homeowners to practice and use the invention, a hole saw 60 of appropriate diameter, e.g. 2 to 3 inches, may be provided for cutting hole 14*b*, in addition to the tube sections with platforms 20, caps 42, conduits 40, guides 30, and fittings and screws needed to assemble the invention to desired lengths of building gutters.

Conduit 40 is secured in place with respect to building 18, for example, by one or more U brackets 46 of the type used for securing gutter down-spouts, for example. Cap 42 and conduit 40 are made of PVC or other known polymer, or of sheet metal or other self supporting material. Alternatively, conduit 40 may be flexible, for example in the form of an expandable tubing of the type used for dryer exhausts or the like. The purpose of conduit 40 is to make a forced air flow from a blower near ground level, available at the inlet 30*c* of guide 30.

According to the gutter cleaning apparatus of the invention with an air outlet connected through a hole in the floor of the gutter and an air inlet spaced below the floor of the gutter and at a level for access by a user standing at ground level, blower 50 is used by engaging the conduit to supply forcing air into the guide 30 and thus clean debris from the gutter 12 using only air, without the mess of water and without wetting the debris and thereby making it heavy, sticky and harder to remove.

By providing a space below the water and air permeable platform 20, and by blowing air both under, via outlet portion 30*a*, and over, via outlet portion 30*b*, the platform, leaves 100 and other debris are simultaneously lifter and lofted from the top of the platform and blown laterally across the platform away from the guide 30, and thus randomly off the gutter 12 along a significant length of gutter.

It is contemplated that a guide 30 will be provided at each end of each length of gutter, with convenient lengths of tube section with platforms 20, strung along the space between the guides and in the channel 14 of the gutter 12.

Figure 2:
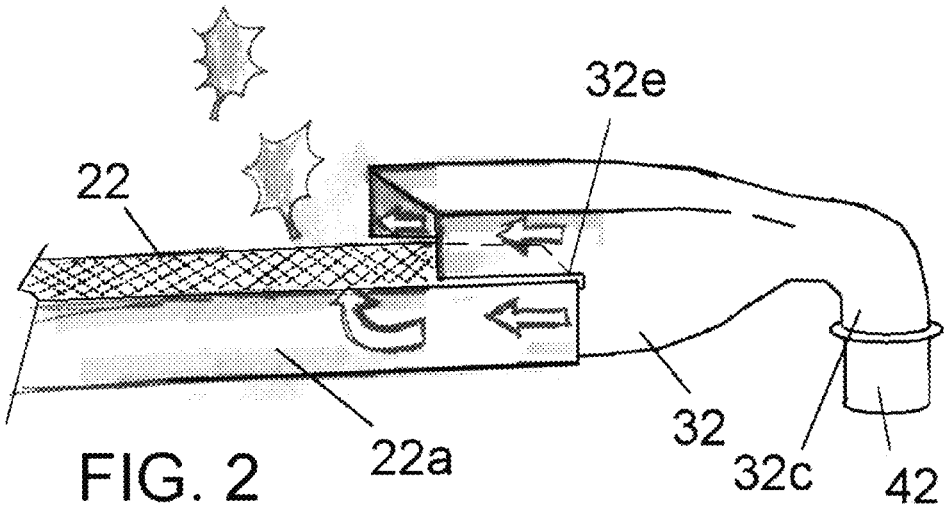
FIG. 2 is a perspective view of another embodiment of the invention.
Figure 3:
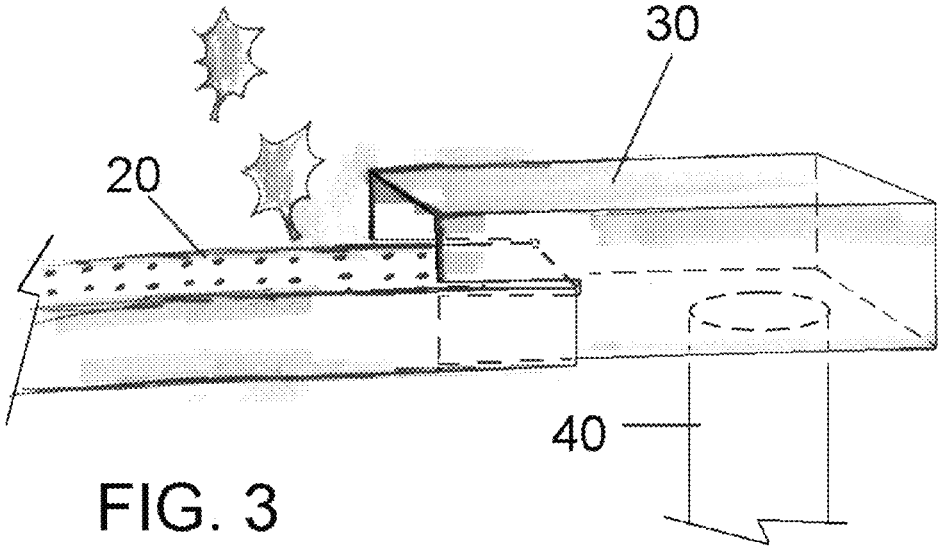
FIG. 3 is a perspective view of a still further embodiment of the invention.

While the water permeable platform 20 is preferably a perforated sheet of metal or other self-supporting material, the water permeable platform may instead, be a sheet of porous material 22 shown in FIG. 2. As also illustrated in FIG. 2, guide 32 may have a pair of slots 32*e* for receiving side walls 22*a* of the tube section forming platform 22, so that the lower outlet of guide 32 fits inside the end of the tube section 22, 22*a*. This may also be an alternate feature of the embodiment of FIG. 1 and shown in FIG. 3. In FIG. 2, another alternate feature, is to have the top, bottom and side wall of guide 32, gradually merge into an elbow shaped guide inlet 32*c* that may be connected to cap 42, or be used without the cap to extend through the hole 14*b* in the floor 14*a* of the gutter 12, and connect to the upper outlet end of conduit 40.

Figure 4:
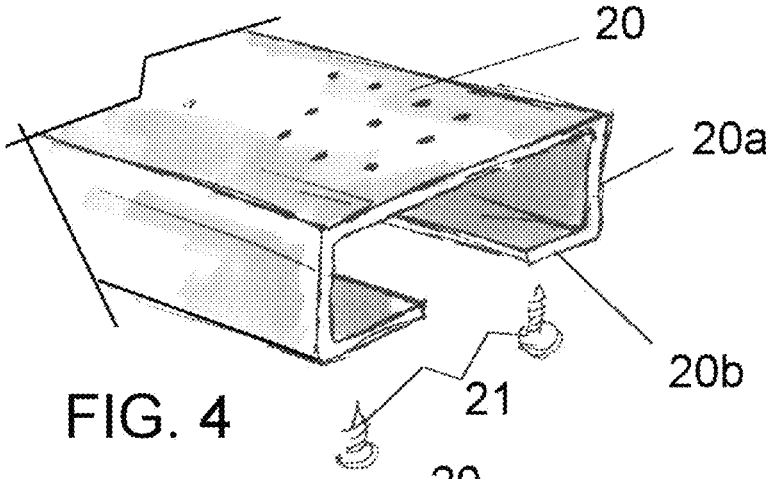
FIG. 4 is a view showing how one embodiment of a tube section or channel with perforated top sheet is attached using screws.
Figure 8:
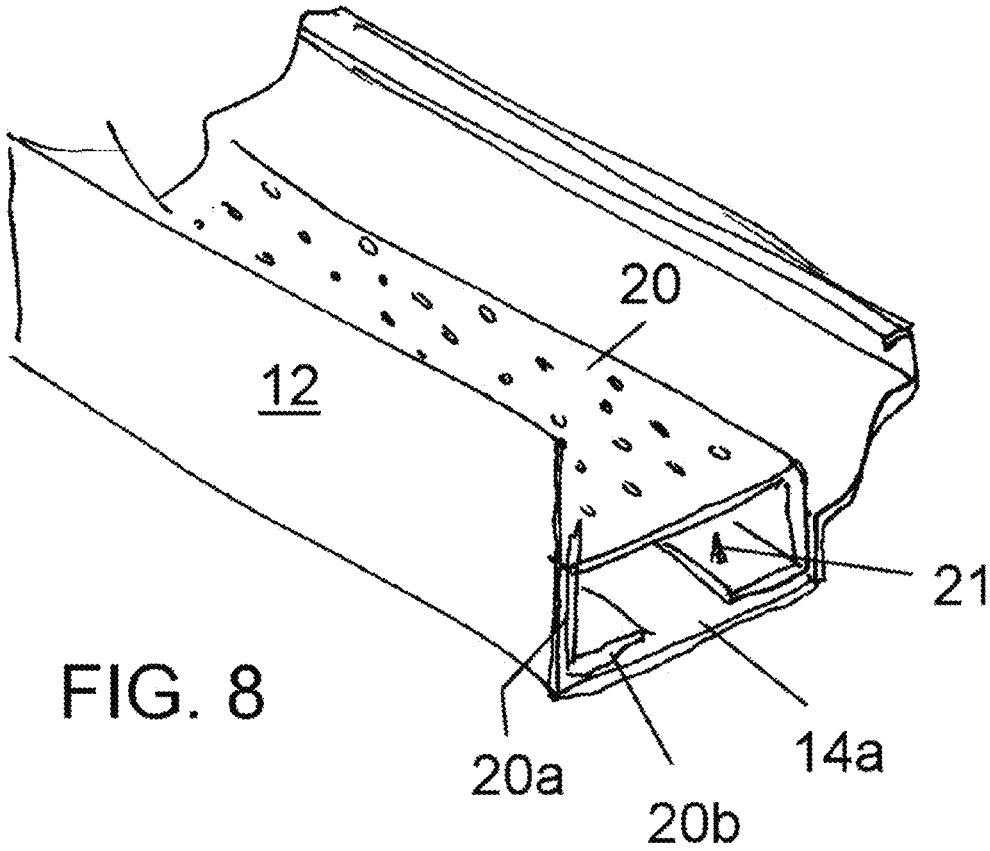
FIG. 8 is a partial perspective view of a tube section or channel of the invention, sitting in and fixed to a gutter according to the present invention.
Figure 9:
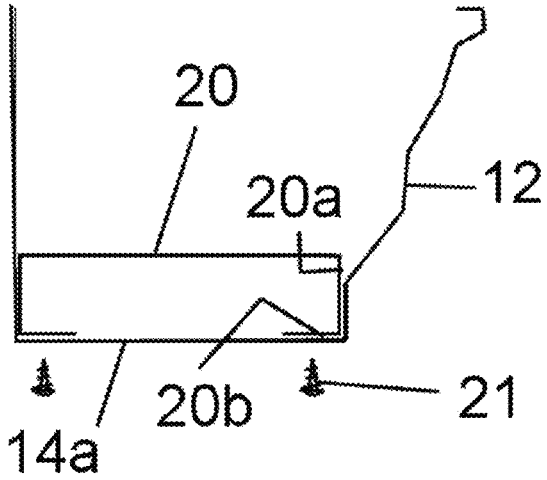
FIG. 9 is a sectional view of the embodiment of FIG. 8.

FIG. 4 illustrates another embodiment of the air and water permeable platform 20 which is part of a tube section or channel having two opposite side sheet portions 20*a* and a pair of bottom sheet portions 20*b* that are used to fix the section to the floor of the gutter using screws 21 that pass through the floor of the gutter (not shown in FIG. 4) and into the bottom sheet portions 20*b* as also shown in FIGS. 8 and 9.

Figure 10:
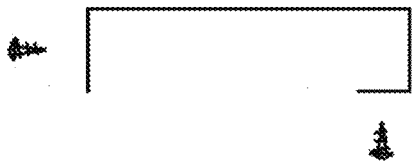
FIG. 10 is a sectional view of an alternate channel section of the present invention.
Figure 11:
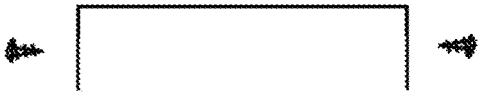
FIG. 11 is a sectional view of a still further alternate embodiment of the channel section of the present invention.
Figure 12:
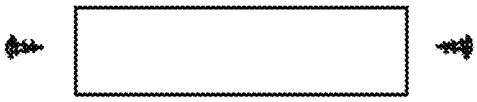
FIG. 12 is a sectional view of a still further alternate embodiment of the channel section of the invention.

FIG. 10 illustrates an embodiment of the tube section with two side sheets and one of the side sheets having a bottom sheet. Screws are used in this embodiment to fix the section to the gutter at one of the side sheets and the one bottom sheet. In FIG. 11 the section has two side sheets and no bottom sheets so screws are used to fix the section to the gutter at two sides of the gutter. In FIG. 12 the section is a closed box beam that can be fixed to the gutter at either or both sides, or at the gutter floor, or any combination thereof. These alternate embodiments of the platform section are useful to allow the sections to be connected to a gutter without removing the gutter where only the bottom or only one side of the gutter are accessible.

Figure 13:
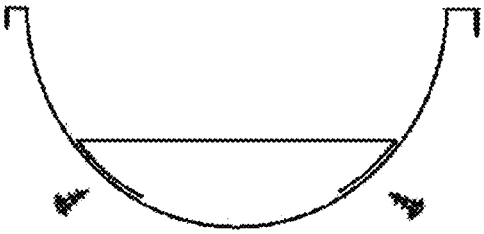
FIG. 13 is a view of a still further embodiment of the invention in combination with a U shaped gutter.

Some gutters are U shaded as shown in FIG. 13. For these the platform section of the invention has a top water permeable platform that includes a pair of opposite curved side sheet portions that extending toward and alone the curved floor of the gutter to be fixed to the gutter by screws or other means like adhesives or rivets. In all embodiments of the invention, alternate fasteners to screws, such as adhesives or rivets, may be used.

Figure 5:
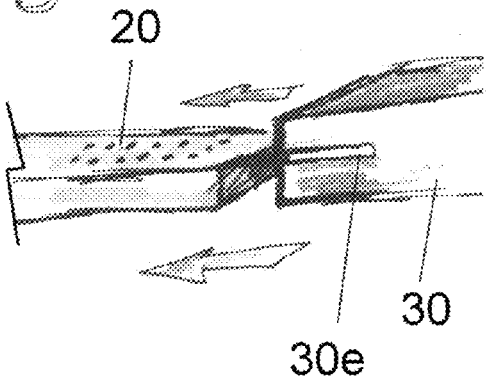
FIG. 5 is a partial perspective view showing how two parts of the apparatus of the invention slide together.
Figure 6:
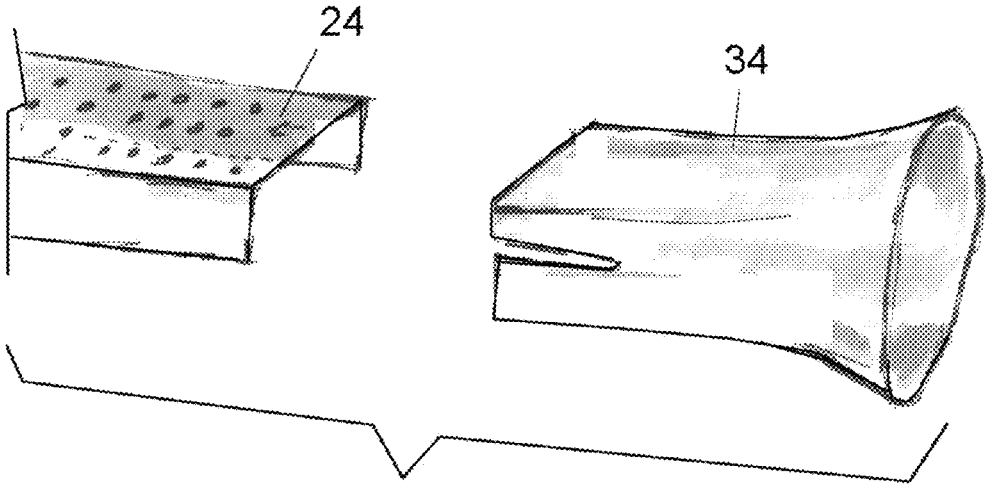
FIG. 6 is a view similar to FIG. 5 of another embodiment of the invention.

Returning to FIG. 5, this figure illustrates how the guide 30 with slots 30*e* engage the end of the last platform section near an end of a gutter (not shown in FIG. 5). FIG. 6 illustrates another embodiment of the invention with a flared and slotted guide 34 that can engage an inverted U shaped platform section 24 like that of FIG. 11. In this embodiment, no hole is needed in the gutter nor is a conduit needed. Rather, a blower is engaged to the open fluted end of the guide 34 to blow air below and over the platform 24. This embodiment of the invention is useful for gutters that are closer to the ground or where the downwardly extending conduit is not desired.

Figure 14:
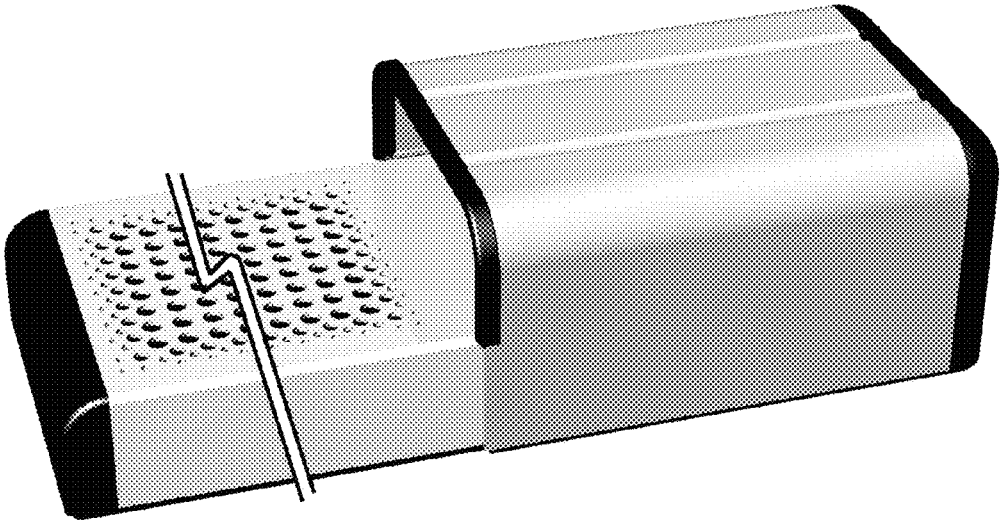
FIG. 14 is a partial perspective view of a guide and platform section of the invention.

FIG. 14 is a less schematic illustration showing a guide of the invention with a perforated platform section having an end extending partly into the guide.

Figure 15:
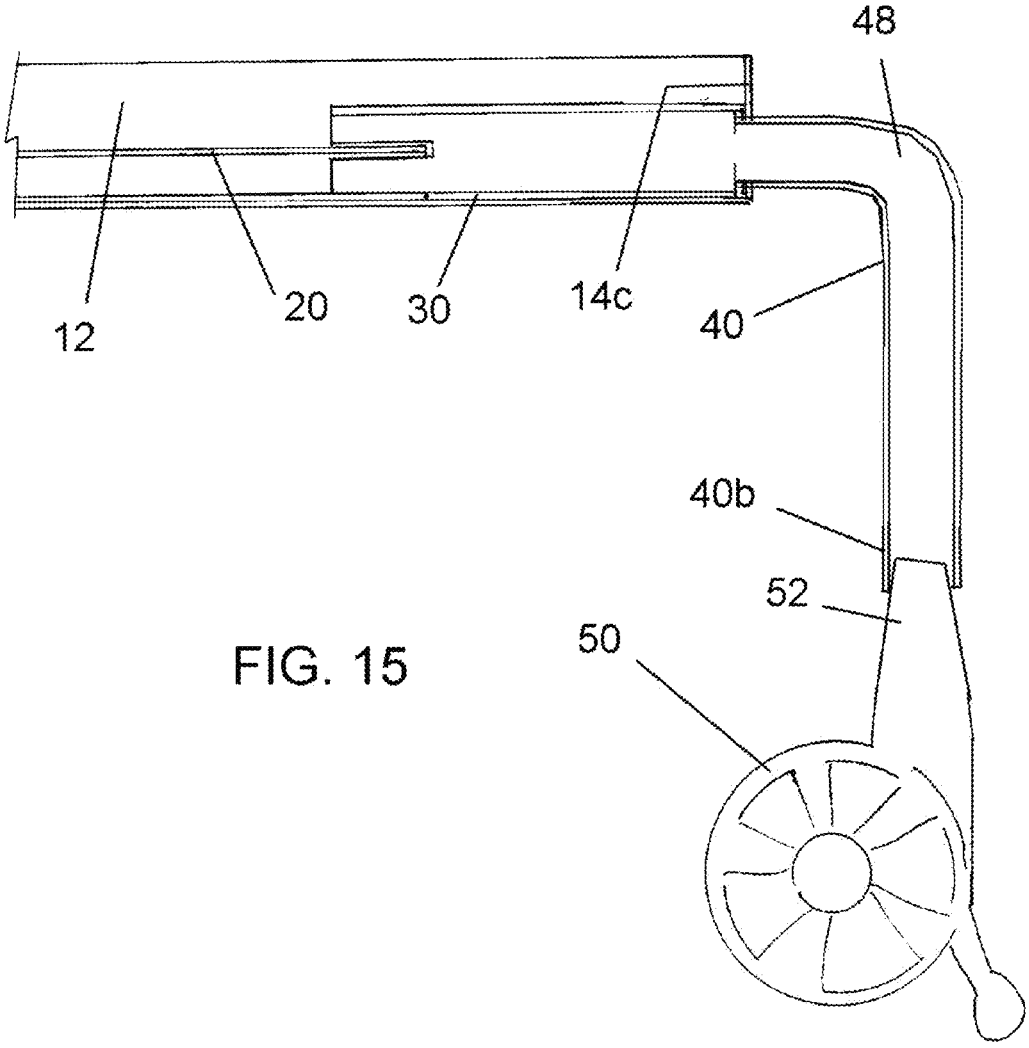
FIG. 15 is a view similar to FIG. 7, of another embodiment of the invention.

FIG. 15 illustrates an embodiment of the invention where access to the inlet of the guide 30 is via a hole in the end cap 14*c* of the gutter 12. A conduit 40 with an elbow 48 is used in this embodiment to reach the blower 50 that is near ground level. The blower outlet tube 52 is engaged with the conduit inlet 40*b* that is near ground level.

Figure 16:
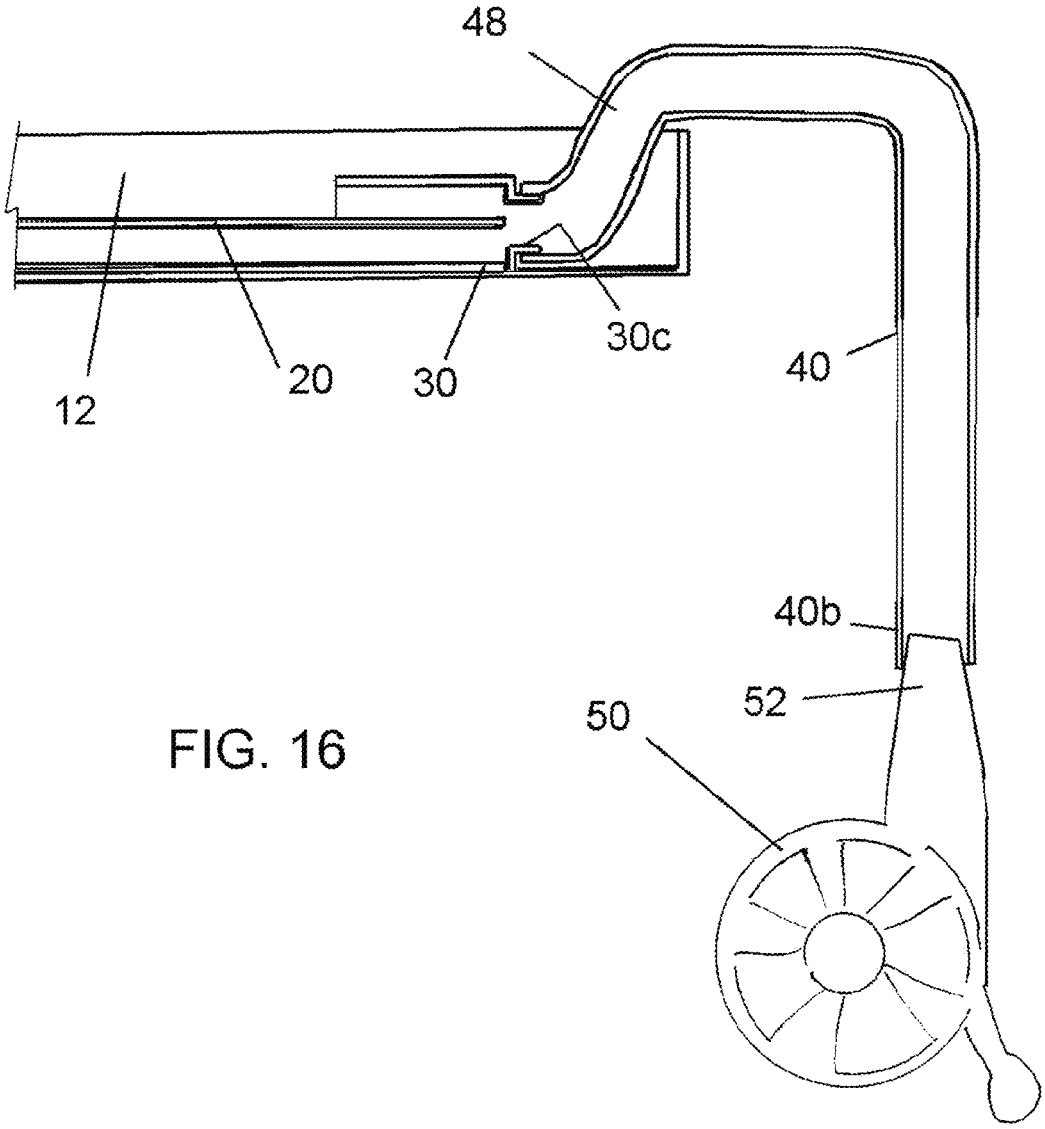
FIG. 16 is a view similar to FIG. 25 of a further embodiment of the invention.

FIG. 16 illustrates an embodiment of the gutter cleaning apparatus of the invention that includes an air flow conduit 40 having an outlet connected at an elbow or curved section 48, over a rim of the gutter, and to a air flow guide inlet 30*c* that is in a rear wall of the 30. The conduit 40 has an inlet 40*b* adapted to be spaced below the floor at a level for access by a user standing at ground level, the apparatus including a blower 50 with an outlet tube 52 engaged with the conduit inlet for supplying forcing air into the conduit inlet to supply air to the guide inlet and thereafter under and over the platform 20.

The gutter cleaning apparatus of the invention, as shown in FIG. 17, may include plastic parts to form for a channel 26 that has an open top with slotted sides that receive a water permeable platform 20 in the form of a permeable sheet of metal or plastic that is slidably engaged to the channel 26 for covering its open top. In an embodiment similar to the one of FIG. 14, but shown in FIG. 18, the apparatus of the invention maybe sold with a number, for example 10, five foot long plastic box beam channels 26 and two plastic box like guide 30.

In the embodiment of FIG. 18 all parts are of plastic and include the box beam channels 26 with top platforms that can be formed of single pieces of molded, extruded or otherwise created materials and are fit together or connected, side-to-side, along the gutter channel. At the end or both ends of each run of channel 26 is a guide 30 with end wall 30*d* with an annular inlet collar 30*c* for a flexible of pre shaped conduit for supplying blower air. The end wall 30*d* also contains a separate of together formed retaining frame 30*e* that is sized and shaped to closely engage the end of channel 26 thereon. The length of channel 26 that extends all the way through guide 30 to engage frame 30*e* may have no perforations to conserve the blowing force until after the air flow leaved the guide 30. If only one guide is used, the far end of the last channel 26 is capped by an end cap 28 to keep air from being lost from the end of the channel rather than used to lift and propel debris form the gutter. A frame piece 36 can also be used to finish the edge of guide 30 at its outlet end.

FIG. 19 shows how the un-perforated portion of platform 20 on an section of channel 26 extending into the guide 30, divides the volume of the guide into a lower portion 30*f* and an upper 30*g* portion. This section of channel 26 is, for example, is about 6 inches long, 3 inches wide and 1 inch tall and is made of aluminum. Its un-perforated platform 20 extends into guide 30 by about 4 inches to engage around the frame or rid 30*e* (seen in FIG. 18) that is, in turn, fixed to the end wall or cap 30*d* that includes the collar 30*c*. Platform 20 this divides the air stream entering the inlet collar 30*c* along arrow A into lower portion along arrow C and upper portion along arrow B, to both lift and fling debris from the gutter.

The channel 26 in FIG. 19 projects by about 2 inches from the end of guide 30 so that it can be connected, e.g. by one or more screws, to a large dimensioned end of a joiner member 29 of plastic. As shown in FIGS. 20 and 21, the joiner member 29 has an opposite small dimensioned end that engages inside a first channel section 26 with perforated platform 20, and is connected by one or more screws to this next channel section. As shown in FIG. 21, any number of sections 26 are thereby connected to each other by laying in a gutter, with the open end of the last channel section 26 being closed by end cap 28. Adhesive or other means may be used to fasten the joiner members 29 and cap 28 to the channels 26.

FIGS. 23 and 24 illustrate an embodiment of the invention wherein a gutter 13 is manufactures with a platform channel 23 and sold as a gutter section for a building. A guide, like that of FIG. 14 or 16 is used at the end of the gutter to pass blower air under and over a platform part 23*a* of the channel 23. Channel 23 has side walls 23*b* with flanges 23*c* in FIG. 23 to slide in slots 13*b* formed on opposite sides of the gutter floor 13*a*. In FIG. 24 no flanges or slots are used but the channel is slide into and captured by the gutter side walls than are slightly inclined toward each other as they rise above the gutter floor.

While specific embodiments of the invention have been shown and described in detail to illustrate the application of the principles of the invention, it will be understood that the invention may be embodied otherwise without departing from such principles.

What is claimed is:

1. A gutter cleaning apparatus for cleaning debris from a gutter having a concave channel for collecting and guiding water from a roof of a building, the apparatus comprising:

a water permeable platform for mounting in a gutter at a selected spacing above a floor of the gutter; and an air flow guide engaged to an end of the platform, the guide having an outlet end with lower and upper portions for directing air flow respectively under and over the platform to lifting and remove debris from an upper surface of the platform, the platform extending at least partly into the outlet end for dividing the outlet end into the lower and upper portions, and the guide having an inlet for receiving a forced air flow.

2. The gutter cleaning apparatus of claim 1, including an air flow conduit having an outlet connected to the air flow guide inlet, and an inlet adapted to be spaced below the floor of the gutter and adapted to receive forced air flow from a blower.

3. The gutter cleaning apparatus of claim 1, including an air flow conduit having an outlet connected to the air flow guide inlet, and an inlet adapted to be spaced below the floor at a level for access by a user standing at ground level, the apparatus including a blower engaged with the conduit for supplying forcing air into the conduit inlet to supply air to the guide inlet.

4. The gutter cleaning apparatus of claim 1, including an air flow conduit having an outlet connected through a hole in the gutter and to the air flow guide inlet, and an inlet adapted to be spaced below the floor at a level for access by a user standing at ground level, the apparatus including a blower engaged with the conduit for supplying forcing air into the conduit inlet to supply air to the guide inlet.

5. The gutter cleaning apparatus of claim 1, including an air flow conduit having an outlet connected over a rim of the gutter and to the air flow guide inlet, and an inlet adapted to be spaced below the floor at a level for access by a user standing at ground level, the apparatus including a blower engaged with the conduit for supplying forcing air into the conduit inlet to supply air to the guide inlet.

6. The gutter cleaning apparatus of claim 1, wherein the water permeable platform is at least one of a perforated sheet and a water porous sheet.

7. The gutter cleaning apparatus of claim 1, wherein the water permeable platform includes at least one side sheet portions for connecting to a side of a gutter.

8. The gutter cleaning apparatus of claim 1, wherein the water permeable platform includes at least one side sheet portion for extending toward the floor of a gutter for setting the selected spacing, and bottom sheet portion along a lower edge of the side sheet portion for connecting to the floor of a gutter.

9. The gutter cleaning apparatus of claim 1, wherein the water permeable platform includes a pair of opposite side sheet portions for extending toward the floor of a gutter for setting the selected spacing, and a pair of bottom sheet portions along respective lower edges of the side sheet portions for connecting to the floor of a gutter.

10. The gutter cleaning apparatus of claim 1, wherein the water permeable platform includes a pair of opposite side sheet portions having curved shape for extending alone the floor of a curved gutter for setting the selected spacing and for connecting to the floor of the curved gutter.

11. The gutter cleaning apparatus of claim 1, wherein the water permeable platform comprises a water permeable sheet, the apparatus including a channel member with an open top, the water permeable platform being slidably engaged to the channel for covering the open top.

12. The gutter cleaning apparatus of claim 1, wherein the water permeable platform comprises a water permeable top wall of a box channel, the guide having a rear wall with an inlet collar and a frame for receiving an end of the box channel in the guide.

13. A gutter cleaning apparatus for cleaning debris from a gutter having a concave channel for collecting and guiding water from a roof of a building, the apparatus comprising:

an air and water permeable platform for mounting in a gutter at a selected spacing above a floor of the gutter;

an air flow guide engaged to an end of the platform, the guide having an outlet end with lower and upper portions for directing air flow respectively under and over the platform to lifting and remove debris from an upper surface of the platform, the platform extending at least partly into the outlet end for dividing the outlet end into the lower and upper portions, and the guide having an inlet for receiving a forced air flow;

an air flow conduit having an outlet connected to the guide inlet, the conduit having an inlet adapted to be spaced below the floor of the gutter at a level for access by a user standing at ground level; and a blower engaged with the conduit for supplying forcing air into the conduit inlet to supply air to the guide inlet.

14. The gutter cleaning apparatus of claim 13, including a gutter section connected to the platform.

15. The gutter cleaning apparatus of claim 13, wherein the permeable platform is a perforated sheet.

16. The gutter cleaning apparatus of claim 13, wherein the permeable platform is a water porous sheet.

17. The gutter cleaning apparatus of claim 13, wherein the permeable platform includes at least one side sheet portions for connecting to a side of a gutter.

18. The gutter cleaning apparatus of claim 13, wherein the permeable platform includes at least one side sheet portion for extending toward the floor of a gutter for setting the selected spacing, and bottom sheet portion along a lower edge of the side sheet portion for connecting to the floor of a gutter.

19. The gutter cleaning apparatus of claim 13, wherein the permeable platform includes a pair of opposite side sheet portions for extending toward the floor of a gutter for setting the selected spacing, and a pair of bottom sheet portions along respective lower edges of the side sheet portions for connecting to the floor of a gutter.

20. The gutter cleaning apparatus of claim 13, wherein the permeable platform includes a pair of opposite side sheet portions having curved shape for extending alone the floor of a curved gutter for setting the selected spacing and for connecting to the floor of the curved gutter.

* * * * *